US006056246A

United States Patent [19]

Argy, II

[11] Patent Number: 6,056,246

[45] Date of Patent: May 2, 2000

[54] ADJUSTABLE NURSING BOTTLE HOLDER

[76] Inventor: Thomas William Argy, II, 2309 N. Rutherford Ave., Chicago, Ill. 60707

[21] Appl. No.: 09/070,855

[22] Filed: Apr. 30, 1998

[51] Int. Cl.[7] ..... A47D 15/00

[52] U.S. Cl. ..... 248/103; 248/106; 248/296.1

[58] Field of Search ..... 248/102, 103, 248/105, 106, 125.1, 125.7, 296.1; 403/234, 235

[56] References Cited

U.S. PATENT DOCUMENTS

| | | | |
|---|---|---|---|
| 626,739 | 6/1899 | Vanderman | 248/296.1 X |
| 824,026 | 6/1906 | Jones | 248/296.1 X |
| 1,005,447 | 10/1911 | Mayo | 248/106 |
| 1,271,994 | 7/1918 | Barlow | 248/103 |
| 1,284,010 | 11/1918 | Wilbur | 248/103 |
| 1,366,872 | 1/1921 | Cantleberry | 248/125.1 |
| 1,688,765 | 10/1928 | Veras | 248/103 |
| 1,874,514 | 8/1932 | Hansen | 248/106 |
| 2,015,280 | 9/1935 | Morishita | 248/451 |
| 2,110,037 | 3/1938 | De Rosa | 248/104 |
| 2,349,054 | 5/1944 | Phipps | 248/106 |
| 2,470,694 | 5/1949 | Foo | 248/106 |
| 2,557,430 | 6/1951 | Hensley et al. | 248/103 |
| 3,298,648 | 1/1967 | Sepanski | 248/103 |
| 3,306,585 | 2/1967 | Blum | 403/234 X |
| 3,398,919 | 8/1968 | Tokar | 248/103 |
| 4,030,690 | 6/1977 | Hanauer et al. | 248/311.3 |
| 5,775,654 | 7/1998 | Price | 248/103 X |

*Primary Examiner*—Ramon O Ramirez
*Assistant Examiner*—Tan Le

[57] ABSTRACT

A nursing bottle holding device for strollers, car seats and the like is provided that holds the nursing bottle firmly but removeably in a bottle holding ring attached to a horizontal arm which slides on a vertical standard that is firmly but removeably secured to the infant appliance. The height and angular position of the bottle can be adjusted for the comfort and safety of the feeding infant by loosening and tightening the horizontal arm which communicates with both the vertical standard and the nursing bottle as a laterally inwardly extending set screw. The device is of knockdown construction for easy portability and storage.

1 Claim, 1 Drawing Sheet

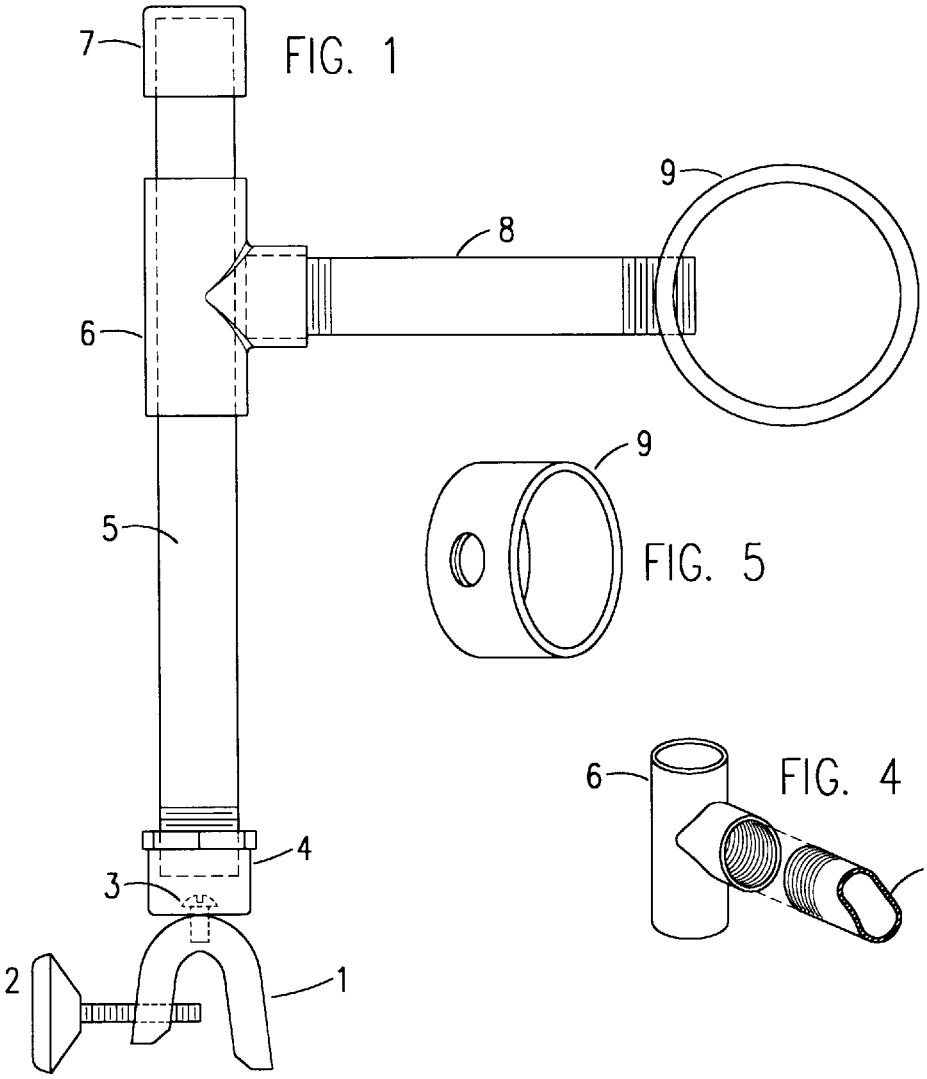
7
FIG. 1
9
8
6
5
9
FIG. 5
6
FIG. 4
8
4
3
2
1
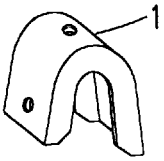
1
FIG. 2
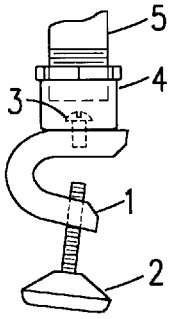
5
4
3
1
2
FIG. 3

ADJUSTABLE NURSING BOTTLE HOLDER

BACKGROUND OF THE INVENTION

1. Field of the Invention

The present invention relates in general to nursing bottle holders. More specifically the present invention relates to a user-friendly nursing bottle holder capable of holding different sizes of bottles and being capable of attachment to various infant appliances such as strollers, automobile seats and baby carriers and capable of adjustment for the comfort and safety of the feeding infant.

2. Prior Art

Devices of this type and for this purpose have been proposed but have not been completely satisfactory for various reasons. In order to provide background information so that the invention may be completely understood and appreciated in its proper context, reference is made to a number of prior art patents as follows: U.S. Pat. No. 1,005,447 to Mayo shows an bottle holder made with small pieces, namely the removeable peg used to restrict the motion of the bottle carrier on the slide carrier which poses a choking hazard to the infant if it should become loose and swallowed. The bottle carrier provides no means for reliably securing the bottle and the sharp edges also pose a laceration threat to the infant. U.S. Pat. No. 1,271,994 to Barlow presents a supporting device for nursing bottles with a bottle clamp preferably made of spring metal and shaped to partially encircle the bottle which puts a sharp edged piece of spring metal within the grasp of the infant and also makes no provisions to reliably hold the bottle in place should the infant grasp and pull on the bottle. U.S. Pat. No. 1,284,010 to Wilbur shows a nursing bottle holder with a bottle holding arm made of resilient wire which poses a puncture wound threat to the infant and does not lend itself to easy adaptability to a variety of nursing bottle sizes. U.S. Pat. No. 1,688,765 to Veras describes a holder for nursing bottles using adjustable clamps to hold the bottle which are secured by means of a nut and bolt and also a telescoping rod fixed in place by means of a thumbscrew. These small parts lend difficulty to the adjustment and use of the device and pose a choking hazard to the infant if they should become loose and are swallowed. U.S. Pat. No. 1,874,514 to Hansen shows a nursing bottle holder using a cup-shaped bottle holder with a lever clamp to firmly hold the bottle without breaking the bottle. This design fails to allow the bottle holder to adapt to different sizes of bottles. U.S. Pat. No. 2,015,280 to Morishita describes a bed accessory support with provisions for holding a nursing bottle. The small set screws used to secure the sliding knuckle and the clamping member and the wingnuts securing the universal joint are all exposed to the grasp of the infant and pose a choking hazard to the infant if they should become loose and are swallowed. U.S. Pat. No. 2,110,037 to De Rosa shows an adjustable bracket using a pair of hingedly connected jaws to fit the sides of the bottle which makes no provision for reliably securing the bottle in place should the infant grasp and pull the bottle and poses a laceration hazard to the infant due to the sharp edges of the hingedly connected jaws. U.S. Pat. No. 2,349,054 to Phipps describes a nursing bottle holder which fails to consider the choking hazard presented by the adjustable strap on the cradle and the thumbscrew threaded into the neck of the vertical sleeve should either of these components become loose and are swallowed by the infant. U.S. Pat. No. 2,470,694 to Foo shows a baby bottle holder with an adjustable step by step clamping band pocket which uses a multitude of small parts for adjustment and thereby exposes the infant to laceration and puncture hazards from the exposed springs and to choking hazards from the thumbscrews, bolts and wingnuts should they become loose and are swallowed. U.S. Pat. No. 2,557,430 to Hensley et al. describes a baby nursing bottle holder which fails to consider the laceration hazards presented by the sharp edges of the spring finger inside the bottle holding band and the choking hazards presented by the wingnuts should they become loose and swallowed by the infant. U.S. Pat. No. 3,298,648 to Sepanski shows a baby bottle holder that uses a friction loop to hold the baby bottle, yet fails to fully describe the means of frictionally engaging the bottle unless it is specific for one type of bottle and is therefore unsuitable for use with a variety of nursing bottle sizes. U.S. Pat. No. 3,398,919 to Tokar describes a nursing bottle holding device which is adjustable for various bottle sizes, yet is so complex as to infuriate the parent attempting to quickly and easily comfort an infant. The multitude of small parts necessary for the adjustment of the device present a choking hazard to the infant if they should become loose and are swallowed and the sharp edges of the exposed spring present a laceration hazard to the parents and the infant. The device is also limited to use on cribs and is not suitable for use with other infant appliances. U.S. Pat. No. 4,030,690 to Hanauer et al. shows a medical equipment device for controlling dispositions of intravenous bottles using a split sleeve member to hold the bottle, but provides no means of rotation or angular adjustment for the bottle. AUSTRALIAN PATENT NO. 136,260 to Kuhl describes an improved holder for a baby's feeding bottle capable of adjustment to various sizes of bottles, but the use of small parts, namely the nuts, bolts and thumbscrews pose choking hazards to the infant if they should become loose and are swallowed and the sharp projecting edges of the clamp pose laceration and puncture hazards to the infant. The present invention is designed to avoid this and other disadvantages of known bottle holding devices.

SUMMARY OF THE INVENTION

My invention addresses the need of parents to be able to do away with the time-consuming task of physically holding the nursing bottle while the infant feeds.

The principal object of the present invention is to provide a user-friendly device easily manipulated by the parent.

It is also an object of the present invention to provide a device which holds various sizes of nursing bottles safely and effectively.

Another object of the present invention is to provide such a device which is of simple, inexpensive construction.

Still another object of the present invention to provide a device which is lightweight in form that can be disassembled quickly and easily for storage.

A further object of the present invention is to provide a device which by its simple construction provides a safer nursing bottle holder than prior art.

An even further object of the present invention is to provide a device which is easily adjustable for the comfort and safety of the infant.

Still yet another object of the present invention is to provide a device which is capable of being mounted to various infant appliances such as strollers, automobile seats and baby carriers.

The foregoing objects and advantages of this invention are accomplished by following the detailed specifications of a preferred embodiment with reference to the accompanying drawings.

BRIEF DESCRIPTION OF THE DRAWINGS

FIG. 1 is a side elevation of an adjustable bottle holder in accordance with the present invention.

FIG. 2 is a fragmentary perspective of the bottom of the device of FIG. 1.

FIG. 3 is a fragmentary side elevation of the bottom portion of such device.

FIG. 4 is a fragmentary perspective of the left center portion of such device.

FIG. 5 is a fragmentary perspective of the right center of such device.

DETAILED DESCRIPTION

As shown in the accompanying drawings, the preferred adjustable nursing bottle holder in accordance with the present invention includes (FIG. 1) a clamp 1 fixed to a threaded base 4 by means of a screw 3, said clamp having three internally threaded holes (FIG. 2). One hole of 5/16" diameter at one end and one hole of ¼" diameter at the opposite end. The third hole is of ¼" diameter and is in the middle of the clamp. This arrangement provides the capability of clamp 1 to be mounted in two ways with threaded knob 2 in the 5/16" diameter hole, first as an inverted U-clamp, (FIG. 1), and second as an inverted C-clamp, (FIG. 2), as desired by the user. The threaded base 4 attaches to the clamp 1 accordingly by means of the screw 3 passing through a ¼" hole drilled in the center of the base. The tubular upright standard 5 is threaded at one end and fitted with a cap 7 at the other end to limit the vertical travel of the vertical sleeve 6. The tubular upright standard 5 screws into the internally threaded base 4 and supports the tubular horizontal member 8 by means of said vertical sleeve. The threaded end of the tubular upright standard 5 provides easy dismantling of the device for storage while leaving the clamp assembly, parts 1, 2, 3, and 4 in place for future use. The threaded end of the tubular upright standard 5 also provides a means for swinging the tubular horizontal member 8 and the bottle holding ring 9 away from and towards the feeding infant as necessary without loosening the vertical sleeve 6 and having to re-adjust the height of said horizontal member 8. The vertical sleeve 6 is fitted over the tubular upright standard 5 between the fitted cap 7 and the internally threaded base 4 and supports the tubular horizontal member 8 by means of an internally threaded neck at its mid-point perpendicular to the tubular upright standard (FIG. 4). The internal threads in the neck of the vertical sleeve 6 permit the tubular horizontal member 8 which is threaded on both ends, one end having threads longer than the other, to be screwed into the vertical sleeve 6 at the end with the longer threads. This arrangement permits the longer threaded end of the tubular horizontal member 8 to communicate with the tubular upright standard 5 through the vertical sleeve 6 as a laterally inwardly extending set screw and thus fix it firmly, but removeably and provide the means for easy adjustment of the height and radial position of said tubular horizontal member 8 and said vertical sleeve 6. The shorter threaded end of tubular horizontal member 8 screws into the bottle holding ring 9 which has an internally threaded hole drilled radially through the mid-point of the side (FIG. 5). The internal threads of the bottle holding ring 9 allow the shorter threaded end of the tubular horizontal member 8 to pass through the bottle holding ring 9 and communicate with a nursing bottle as a laterally inwardly extending set screw and fix it firmly, but removeably in the desired position. This arrangement also allows the device to hold bottles of different diameters and to adjust the angular position of the bottle relative to said tubular horizontal member 8. The device in its preferred embodiment is of tubular plastic construction, but may be made with vertical and horizontal members of triangular, square or other cross-section. The bottle holding ring and the vertical sleeve can also be of triangular, square or other cross-section as desired. While there have been shown and described what are considered at present to be the preferred embodiments of the present invention, it will be appreciated by those skilled in the art that modifications of such embodiments may be made. It is therefore desired that the invention not be limited to these embodiments and it is intended to be covered in the appended claims all such modifications as fall within the true spirit and scope of the invention.

In use the adjustable bottle holder may be clamped to different infant appliances such as strollers, automobile seats and baby carriers as desired by the patent. The adjustable bottle holder is of knockdown construction affording easy portability and storage. The plastic construction is easily mass-produced and easily maintained by the user. The easy manipulation and adjustability of the device allows for the comfort and safety of the infant.

What is claimed is:

1. An adjustable nursing bottle holder comprising:

a bottle holding ring having an internally threaded hole drilled radially through a midpoint between an upper and lower rims of the ring;

a horizontal arm threaded at both ends, one end having threads shorter than the other end, said shorter threaded end of said horizontal arm used as a laterally inwardly extending set screw to firmly but removably fix to said holding ring, said shorter threaded end of said horizontal arm passed through said internally threaded hole of said ring and adapted to hold a nursing bottle firmly but removably at a desired position, said shorter threaded end of said horizontal arm also adapted to hold bottles of different diameters and to adjust an angular position of the bottle relative to said horizontal arm and a nursing infant;

a vertical sleeve having an internally threaded neck at its mid point between an upper and lower ends, said longer threaded end of said horizontal arm entering said vertical sleeve through said threaded neck at the mid-point between the upper and lower ends of said vertical sleeve, said longer threaded end of said horizontal arm also used as a laterally inwardly extending set screw to firmly but removably fix to said vertical sleeve;

a tubular upright standard having a lower end and an upper end, said lower end is threaded and said upper end is fitted with a cap, said vertical sleeve is slidably fitted over the tubular upright standard between the fitted cap and the threaded end, said threaded end of said tubular upright standard adapted to provide a means for swinging said horizontal arm and said bottle holding ring away from and toward the nursing infant as necessary without loosening the vertical sleeve and having to re-adjust a height of said horizontal arm; said fitted cap acted as an upper limit for the vertical travel of said vertical sleeve;

a base having an internally threaded base, said internally threaded base adapted to receive said lower threaded portion of said vertical standard and to act as a lower limit of a vertical travel of said vertical sleeve;

a clamp, said clamp being C-shaped and having three internally threaded holes, one internally threaded hole through an outer upper horizontal surface of said C-shaped clamp, a second internally threaded hole through an outer vertical surface of said C-shaped clamp and a third internally threaded hole through an outer lower horizontal surface of said C-shaped clamp, said internally threaded base firmly but removably fixed to said clamp by means of a screw through a center of a bottom of said internally threaded base into said clamp;

said C-shaped clamp having a threaded knob inserted into said internally threaded hole through the outer lower horizontal surface of said C-shaped clamp for securing said C-shaped clamp firmly but removably to a supporting surface, in this position, said internally threaded hole through the outer upper horizontal surface of said C-shaped clamp will receive said screw through the center of the bottom of said internally threaded base as desired by the user as an alternate to the C-clamp configuration, said C-shaped clamp may be firmly but removably attached to a supporting surface in an inverted U-shaped configuration, in this position said internally threaded hole through the outer vertical surface of said C-shaped clamp would receive said screw through the center of the bottom of said internally threaded base.

* * * * *